US011619227B2

(12) United States Patent
Besnier et al.

(10) Patent No.: US 11,619,227 B2
(45) Date of Patent: Apr. 4, 2023

(54) POSITIVE DISPLACEMENT PUMP HAVING AN ECCENTRIC PISTON

(71) Applicant: MOUVEX, Auxerre (FR)

(72) Inventors: Yann Besnier, Lindry (FR); Alexis Fontaine, Auxerre (FR)

(73) Assignee: MOUVEX, Auxerre (FR)

( * ) Notice: Subject to any disclaimer, the term of this patent is extended or adjusted under 35 U.S.C. 154(b) by 318 days.

(21) Appl. No.: 16/800,921

(22) Filed: Feb. 25, 2020

(65) Prior Publication Data

US 2020/0271112 A1 Aug. 27, 2020

(30) Foreign Application Priority Data

Feb. 26, 2019 (FR) ..... 1901934

(51) Int. Cl.
*F04C 2/32* (2006.01)
*F04C 15/00* (2006.01)

(52) U.S. Cl.
CPC ..... *F04C 2/32* (2013.01); *F04C 15/0007* (2013.01); *F04C 15/0065* (2013.01)

(58) Field of Classification Search
CPC ..... F04B 49/125; F04B 53/006; F04B 53/14; F04C 2/32; F04C 2/34; F04C 2/10; F04C 15/0007; F04C 15/0065; F04C 15/00; F04C 15/0003; F04C 15/0015; F04C 15/0061; F04C 2240/601; F04C 2240/30; F04C 2240/60; F04C 18/32; F04C 27/001; F04C 27/003; F04C 29/0057; F04C 29/005; F04C 29/0078; F04C 21/002; F01C 17/00; F01C 17/063; F01C 17/06; F01C 19/00; F01C 19/02; F16C 3/02; F16C 2360/42; F16D 3/005
See application file for complete search history.

(56) References Cited

U.S. PATENT DOCUMENTS 762,539 A 6/1904 Leiman et al.
3,274,799 A * 9/1966 Danner ..... A01K 63/047 415/124.2
5,040,958 A * 8/1991 Arata ..... F04C 18/0215 418/57

(Continued)

FOREIGN PATENT DOCUMENTS

DE 102018212819 A1 2/2019
WO 97/36107 A1 10/1997

OTHER PUBLICATIONS

Search Report for French Patent App. No. 863667 (dated Oct. 17, 2019).

*Primary Examiner* — Nathan C Zollinger

(57) ABSTRACT

Some embodiments are directed to a positive displacement pump having an eccentric piston, comprising a tube having a first end and a second end that is terminated by a cylinder secured to a delivery zone, the tube including an intake opening and a delivery opening, a drive shaft extending between the transmission zone and the tube, a piston arranged in the delivery zone and mounted in a sliding manner at the end of the shaft, being pressed against the cylinder by an elastic presser so as to prevent fluid displacement between the tube and the delivery zone when the pump is dry, and the elastic presser is provided to press the piston against the cylinder when the pump is running under load.

7 Claims, 2 Drawing Sheets

(56) References Cited

U.S. PATENT DOCUMENTS

| | | | | | |
|---|---|---|---|---|---|
| 5,131,826 | A * | 7/1992 | Boussicault | F01C 20/06 | 418/23 |
| 5,399,076 | A * | 3/1995 | Matsuda | F04C 18/32 | 418/59 |
| 5,520,524 | A * | 5/1996 | Takemoto | F04C 29/0057 | 418/57 |
| 5,983,738 | A * | 11/1999 | Delaisse | F04C 15/0065 | 74/18.1 |
| 11,319,955 | B2 * | 5/2022 | Bariau | F04C 15/0065 | |

* cited by examiner

[Fig. 1]
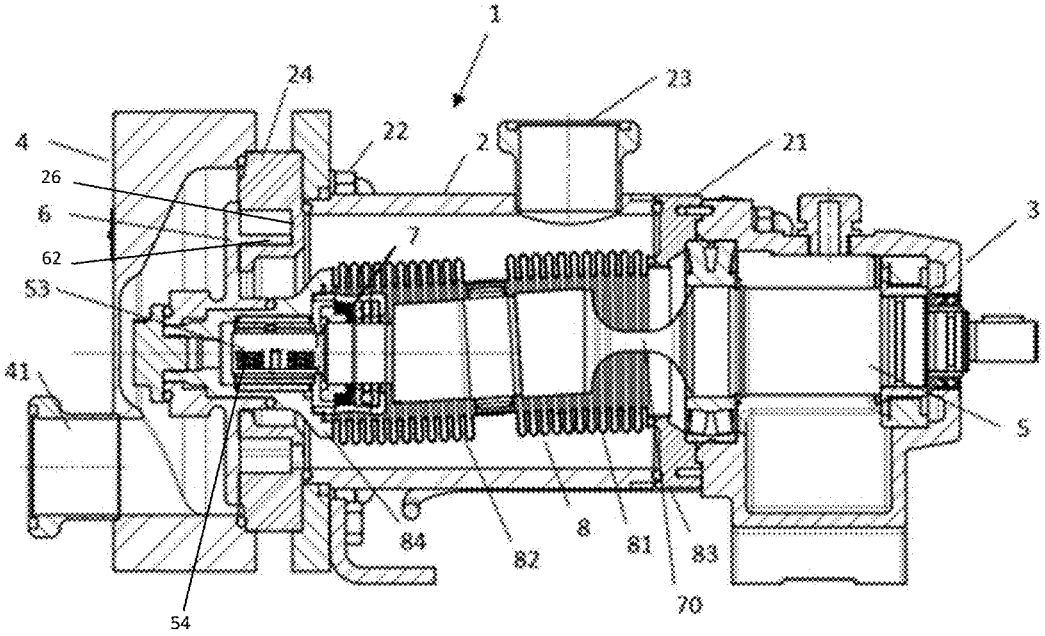
[Fig. 2]
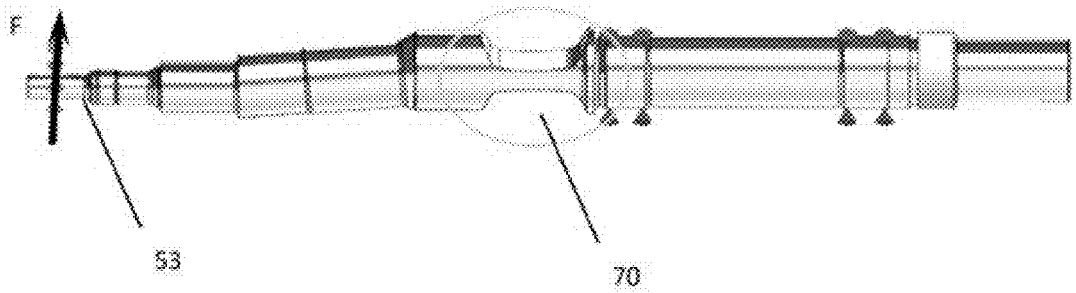

[Fig. 3]
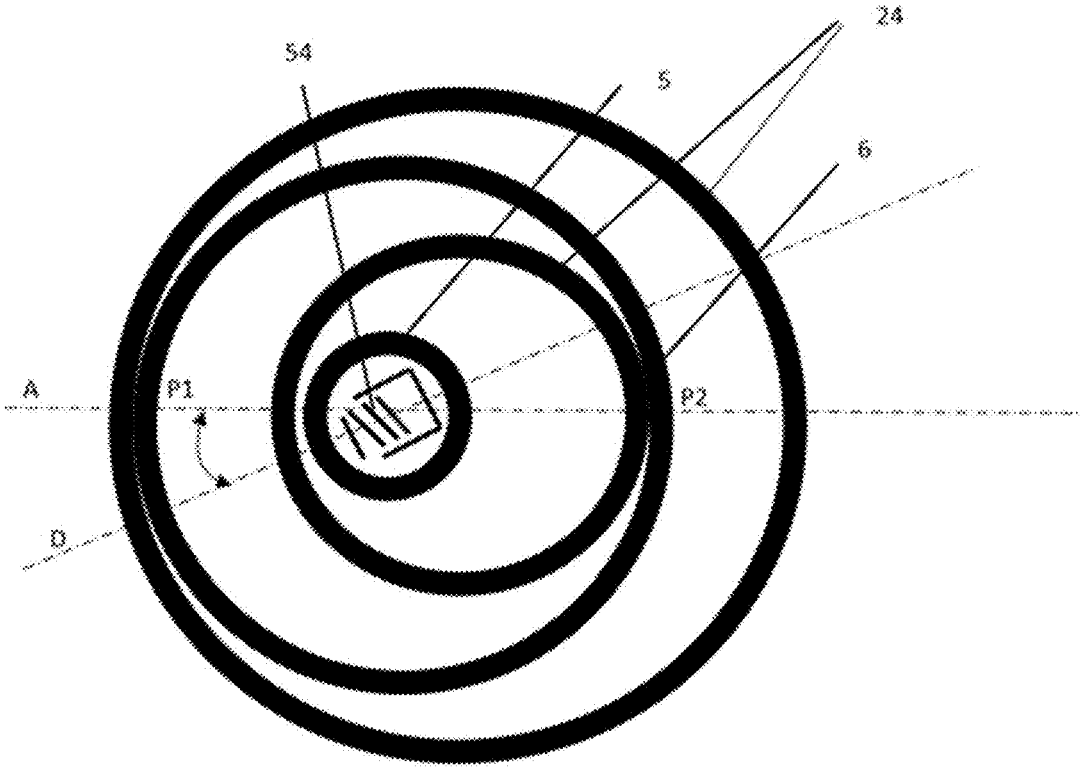
[Fig. 4]
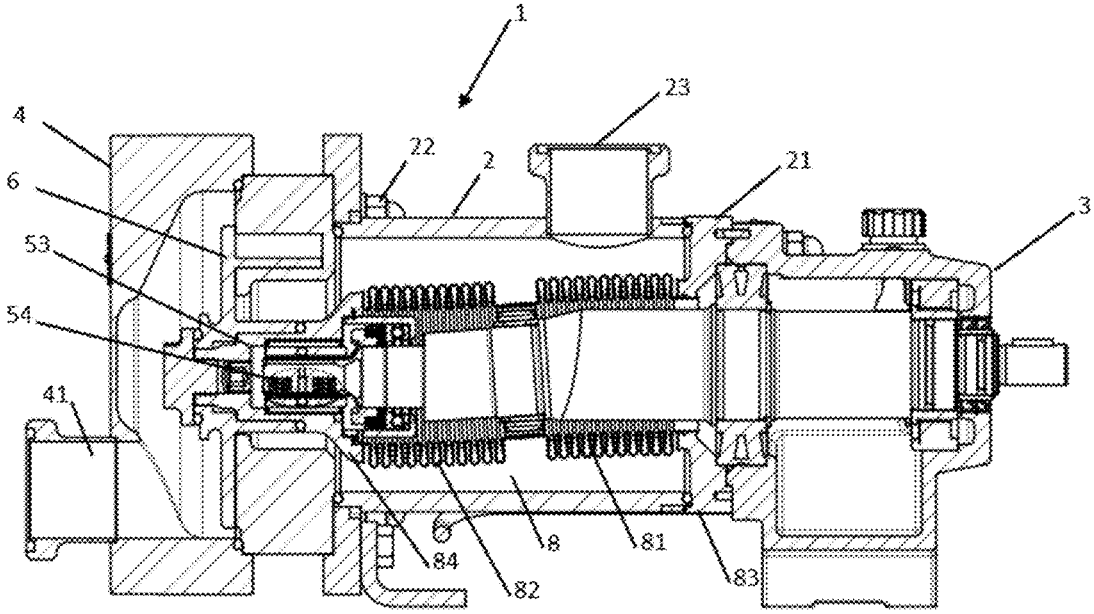

POSITIVE DISPLACEMENT PUMP HAVING AN ECCENTRIC PISTON

CROSS REFERENCE TO RELATED APPLICATION(S)

This application claims the priority benefit under 35 U.S.C. § 119 of French Patent Application No. 1901934, filed on Feb. 26, 2019, the content of which is hereby incorporated by reference in its entirety.

BACKGROUND

Some embodiments are directed to the field of pumps, in particular positive displacement pumps having an eccentric piston.

A positive displacement pump having an eccentric piston generally includes a cylinder including an intake opening and sharing an end with a delivery zone. At this end, a piston is mounted in a sliding manner on the end of a drive shaft and is pressed by pressers, such as springs, against the cylinder, thereby preventing the passage of fluid. When the pump is running under load, the pressure exerted on the piston can cause the drive shaft to flex. The corresponding pressure force can then cause the piston to detach from the cylinder, thereby causing leaks that have a negative effect on the efficiency of the pump.

An example of a positive displacement pump having an eccentric piston is described and depicted in the related art document WO97/36107. A circular piston carries out an orbital movement within a cylinder delimited by two circular walls with different diameters. The diameter of the piston is clearly between these two diameters. The cylinder is provided with a wall 26 for isolating the intake chamber and delivery chamber. The skirt 62 of the piston is interrupted in line with this wall, also referred to as partition. The center of the piston moves in a circular motion while the piston does not turn on itself, meaning that the x-axis and y-axis remain permanently parallel to their initial orientation.

SUMMARY

Some embodiments of the presently disclosed matter are therefore directed to overcome the drawbacks of the related art document mentioned above and in particular to reduce, if not eliminate leaks between the piston and the cylinder of the pump during running under load.

Accordingly, some embodiments are directed to a positive displacement pump having an eccentric piston, including a tube having a first end secured to a transmission zone and a second end that is terminated by a cylinder secured to a delivery zone, the tube including an intake opening and the delivery zone including a delivery opening, a drive shaft extending between the transmission zone and the tube with one end situated by the cylinder, a piston arranged in the delivery zone and mounted in a sliding manner at the end of the shaft, being pressed against the cylinder by one or more elastic pressers so as to prevent fluid displacement between the tube and the delivery zone when the pump is dry, wherein the elastic pressers are designed to press the piston against the cylinder when the pump is running under load, and in that the elastic pressers includes at least one radial spring mounted at the end of the piston, the direction of the return force of the spring forming a non-zero angle with a straight line passing through the two points of contact between the piston and the cylinder when the pump is dry.

The angular offset of the radial spring makes it possible to ensure that the direction of the return force is substantially parallel to the straight line connecting the points of contact between the piston and the cylinder when the pump is under load.

According to some embodiments, the angle is between 1 and 30°.

According to some embodiments, the elastic presser includes a first portion of the drive shaft, the cross-sectional area of which is less than the cross-sectional areas of the adjacent portions so as to be able to deform elastically during the rotation of the drive shaft.

The elastic deformation of the first portion of the shaft makes it possible to keep the piston pressed against the cylinder of the pump with a known pressing force.

According to some embodiments, the first portion forms a flexible strip.

According to some embodiments, the cross-sectional area of the first portion is rectangular.

According to further advantageous features:

- the piston carries out an orbital movement within the cylinder when the pump is running;
- the cylinder is delimited by two circular walls with different diameters, the diameter of the piston being between these two diameters;
- the cylinder is provided with a wall for isolating the intake opening and the delivery zone;
- the skirt of the piston is interrupted in line with the wall.

BRIEF DESCRIPTION OF THE DRAWINGS

Further features and advantages of some embodiments of the presently disclosed subject matter will become more clearly apparent from reading the following detailed description of some exemplary embodiments, which is given by way of non-limiting example and is illustrated by the appended drawings, wherein:

FIG. 1 shows a view in longitudinal section of an eccentric positive displacement pump according to some embodiments, FIG. 2 shows a view of the drive shaft of the pump according to some embodiments, FIG. 3 shows a schematic view according to some other embodiments, FIG. 4 shows a view in longitudinal section of an eccentric positive displacement pump according to some other embodiments.

DETAILED DESCRIPTION OF EXEMPLARY EMBODIMENTS

FIG. 1 shows a positive displacement pump 1 having an eccentric piston according to some embodiments as seen in longitudinal section.

The pump 1 includes a tube 2 having a first end 21 and a second end 22 and also an intake opening 23.

The first end 21 of the tube 2 is secured to a transmission zone 3, which includes a transmission mechanism of the pump 1. The second end 22 includes a cylinder 24 and is secured to a delivery zone 4, which includes a delivery opening 41.

A drive shaft 5 extends from the transmission zone 3 into the tube 2. One end 53 of the shaft 5 is situated by the cylinder 24.

As can be seen in FIG. 1, in this exemplary embodiment, a sleeve 8 is arranged in the tube 2 around the shaft 5. The sleeve 8 includes a two-part metal bellows 81, 82, which can be made of steel, for example. The sleeve 8 is fastened in a sealed manner to the first end 21 of the tube 2 by first fasteners 83 and to the end 53 of the shaft 5 by second fasteners 84. Such a sleeve is known per se to a person of ordinary skill in the art. It is described in detail for example in the related art document WO97/36107.

The second fasteners 84 of the sleeve are likewise secured to the piston and can thus slide over the end 53 of the shaft 5 at the same time as the piston.

A piston 6 is arranged in the delivery zone 4 and mounted in a sliding manner at the end 53 of the shaft 5. Elastic pressers 7, 70 press the piston such that the latter is pressed against the cylinder 24 so as to prevent any fluid displacement between the tube 2 and the delivery zone 4. The operation of such a pump is known to a person of ordinary skill in the art.

The elastic pressers includes for example a first portion 70 of the drive shaft 8, the cross-sectional area of which is less than the cross-sectional areas of the adjacent portions. In other words, the first section is thinner than the sections. This thinning allows elastic deformation of the drive shaft 5 when the pump 1 is running. The orientation of the first section 70 is chosen such that the piston 6 is pressed against the cylinder 24 by the bending force exerted by the first section 70.

According to the embodiment shown in FIG. 2, the first section 70 is in the form of a flexible strip with, for example, a rectangular section. The elastic deformation is exerted on the thinnest part of the strip and exerts a return force in the direction F. The thickest part ensures force take-up linked to the pressure exerted on the piston.

The cylinder 24 is equipped with a partition (not shown), which separates the intake zone and the delivery zone of the pump 1. At this location, the disc of the piston has an opening for the partition to pass through. This discontinuity in the pumping cycle temporarily brings about forces that help to realign the piston.

The use of a first, thinned portion 70 of drive shaft 5, such as a flexible strip, makes it possible to have a more reactive piston that is realigned more quickly. Furthermore, the first, thinned portion 70 makes it possible to do away with radial springs mounted at the end 53 of the drive shaft. These springs, in a known manner, press the piston 6 against the cylinder. The forces of the springs are taken up by a bearing bushing which is rubbed by a sliding ring secured to the piston. During the realignment of the piston, the rubbing of the ring against the bearing bushing slows down the realignment movement of the piston, this having a negative effect on the efficiency of the pump 1.

According to some other embodiments, the elastic pressers includes at least one radial spring 54 mounted at the end of the drive shaft 5. The radial spring(s) is (are) arranged so as to press the piston 6 against the cylinder 24 both when the pump is running dry and when the pump is running under load. In other words, the orientation of the radial spring(s) on the end of the drive shaft 5 is chosen so as to compensate the pressure force that is exerted on the piston 6 and tends to cause the drive shaft 5 to flex.

FIG. 3 schematically shows the orientation of the radial spring(s) on the end of the drive shaft 5 when the pump is running dry. According to some embodiments, the radial spring(s) is (are) mounted with an angular offset with respect to a straight line A passing through the points of contact P1 and P2 between the piston 6 and the cylinder 24. This angular offset allows the direction D of the return force of the radial spring(s) to make a non-zero angle with the straight line A. The angle is determined such that, when running dry, the component of the return force parallel to the straight line A is sufficient to keep the piston 6 pressed against the cylinder, as shown in FIG. 3.

When the pump 1 is running under load, the pressure force that is exerted on the piston 6 tends to cause the shaft to flex and thus to shift the points of contact P1 and P2 between the piston 6 and the cylinder. The straight line A thus changes orientation. According to some embodiments, the angular offset is chosen such that, when the pump 1 is running under load, the direction of the return force of the radial spring(s) coincides with the new straight line that connects the points of contact between the piston 6 and the cylinder 24. Thus, when running under load, the component of the return force is at a maximum when aligned with the points of contact with the piston 6 and the cylinder 24.

According to some embodiments, the angle between the straight line A connecting the points of contact P1 and P2 when the pump is running dry and the direction D of the return force of the radial spring(s) is between 1 and 30°.

According to some embodiments, the drive shaft 5 including the first, thinned portion 70 may or can include one or more radial springs mounted at the end of the drive shaft 5 with an angular offset with respect to the straight line A.

It will be understood that various modifications and/or improvements that are obvious to a person of ordinary skill in the art can be made to the different embodiments of the presently disclosed subject matter that are described in the present description, without departing from the scope of the presently disclosed subject matter.

The invention claimed is:

1. A positive displacement pump having an eccentric piston, comprising:

a tube having a first end secured to a transmission zone and a second end that is terminated by a cylinder secured to a delivery zone, the tube comprising an intake opening and the delivery zone including a delivery opening, the cylinder comprising two concentric circular walls having different diameters, a drive shaft extending from the transmission zone and through the tube with one end situated by the cylinder, and a piston arranged in the delivery zone and mounted in a sliding manner at the end of the drive shaft, the piston comprising a circular piston having a diameter between a diameter of the two circular walls of the cylinder, the piston configured to carry out an orbital movement between the two concentric circular walls, the piston being pressed against the two circular walls of the cylinder by an elastic presser so as to prevent fluid displacement between the tube and the delivery zone when the pump is dry, wherein the piston forms two points of contact with the two circular walls of the cylinder across a longitudinal cross section of the piston, wherein the elastic presser is designed to press the piston against the cylinder when the pump is running under load, and in that the elastic presser includes at least one spring mounted at the end of the drive shaft, the direction of the return force of the spring forming a non-zero angle with a straight line (A) passing through the two points of contact between the piston and the cylinder when the pump is dry, and wherein the non-zero angle is between 1 and 30°.

2. The positive displacement pump having an eccentric piston according to claim 1, wherein the elastic presser further includes a first portion of the drive shaft, the cross-sectional area of which is less than the cross-sectional areas of the adjacent portions so as to be able to deform elastically during the rotation of the drive shaft.

3. The positive displacement pump having an eccentric piston according to claim 2, wherein the first portion forms a flexible strip configured to deform elastically under force.

4. The positive displacement pump having an eccentric piston according to claim 2, wherein the cross-sectional area of the first portion taken perpendicular to the longitudinal axis of the drive shaft is rectangular.

5. The positive displacement pump having an eccentric piston according to claim 1, wherein the piston carries out an orbital movement within the cylinder when the pump is running.

6. The positive displacement pump having an eccentric piston according to claim 1, wherein the cylinder is provided with an isolation wall for isolating the intake opening and the delivery zone.

7. The positive displacement pump having an eccentric piston according to claim 6, wherein a skirt of the piston is interrupted in line with the isolation wall.

* * * * *